US005970666A

United States Patent [19]

Kurabayashi et al.

[11] Patent Number: 5,970,666

[45] Date of Patent: Oct. 26, 1999

[54] LARGE-SCALE HIGH STRENGTH SEISMIC ISOLATOR

[75] Inventors: Hiroshi Kurabayashi, Tokyo; Toshio Omi, Sakura; Daisuke Yaguchi, Ichikawa; Nobuyoshi Murai, Inzai; Yoshihide Uchiyama, Funabashi; Masashi Yamamoto, Shiroi-machi; Yuji Sano, Ohba; Hirokazu Yoshioka, Inzai; Takeki Shirai, Ichikawa; Hidekazu Michioka, Fujisawa; Masashi Konomoto, Tokyo, all of Japan

[73] Assignees: Mitsubishi Steel Mfg. Co., Ltd, Tokyo; Takenaka Corporation, Osaka; THK Co., Ltd, Tokyo, all of Japan

[21] Appl. No.: 08/986,133

[22] Filed: Dec. 5, 1997

[30] Foreign Application Priority Data

Dec. 11, 1996 [JP] Japan ..... 8-331056

[51] Int. Cl.[6] ..... E02D 27/34; E04B 1/98; E04H 9/02

[52] U.S. Cl. ..... 52/167.6; 52/167.8; 52/167.1; 52/167.4

[58] Field of Search ..... 52/167.1, 167.4, 52/167.5, 167.6, 167.7, 167.8

[56] References Cited

U.S. PATENT DOCUMENTS 3,730,463 5/1973 Richard ..... 52/167.6 X
4,330,103 5/1982 Thuries et al. ..... 52/167.6 X
4,599,834 7/1986 Fujimoto et al. ..... 52/167
4,662,133 5/1987 Kondo ..... 52/167
4,917,211 4/1990 Yamada et al. ..... 52/167.6 X
5,761,856 6/1998 Kishizono et al. ..... 52/167.8
5,816,559 10/1998 Fujimoto ..... 52/167.6 X

*Primary Examiner*—Christopher T. Kent
*Assistant Examiner*—Yvonne Horton-Richardson
*Attorney, Agent, or Firm*—Flynn, Thiel, Boutell & Tanis, P.C.

[57] ABSTRACT

A seismic isolator includes a lower guide rail 4 having grooves on the side surfaces thereof and fitted to an upper surface of a lower plate 1, an upper guide rail 6 having grooves on the side surfaces thereof and fitted to a lower surface of an upper plate in a direction criss-crossing the lower guide rail 4, a block body 9 clamping at its lower part the lower guide rail 4 and clamping at its upper part the upper guide rail 6, a large number of rollers interposed between the lower guide rail 4 and the block body 9 and between the upper guide rail 6 and the block body 9, a large number of balls interposed between grooves of the side surfaces of the lower guide rail 4 and the block body 9 and between grooves of the side surfaces of the upper guide rail 6 and the block body 9 and a flexible member 22 fitted between the lower surface of the upper plate and the upper surface of the lower plate 1.

5 Claims, 8 Drawing Sheets

LARGE-SCALE HIGH STRENGTH SEISMIC ISOLATOR

BACKGROUND OF THE INVENTION

1. Field of the Invention

This invention relates to a seismic isolator for protecting a structure such as a building from vibrations such as an earthquake.

2. Description of the Prior Art

Conventional seismic isolators include generally those which interpose flexible members between a foundation and a structure and those which dispose vibration damping means and structure restoring means besides the flexible members.

In the conventional seismic isolators, however, a pull-out resistance force which inhibits upward displacement of a structure is small, and setting of a load bearing force, rigidity and horizontal deformation capacity per unit seismic isolator is limited. Furthermore, since these performance factors interfere with one another, the individual performance factors cannot be changed greatly.

SUMMARY OF THE INVENTION

It is an object of the present invention to provide a seismic isolator which solves these problems, has large pull-out resistance force, load bearing force, rigidity and horizontal displacement capacity and can independently set restoring force and damping force without interfering with each other.

The present invention provides a large-scale high strength seismic isolator which comprises a linear lower guide rail having continuous grooves on the side surfaces thereof and fitted to the upper surface of a lower plate; a linear upper guide rail having continuous grooves on the side surfaces thereof and fitted to the lower surface of an upper plate in a direction orthogonally crossing the lower guide rail; a block body clamping from above and movably the lower guide rail at a lower part thereof and clamping from below and movably the upper guide rail at an upper part thereof; a large number of first rolling members inserted between the upper surface of the lower guide rail and the block body and between the lower surface of the upper guide rail and the block body; a large number of second rolling members inserted between the grooves of the side surfaces of the lower guide rail and the block body and between the grooves of the side surfaces of the upper guide rail and the block body; and a viscoelastic member fitted between the lower surface of the upper plate and the upper surface of the lower plate. Preferably, a plurality of upper and lower guide rails are disposed, respectively, and the viscoelastic member is preferably a superplastic or high damping rubber damper.

According to a second aspect of this invention, the viscoelastic member is disposed in an empty space between the lower and upper guide rails of the large-scale high strength seismic isolator and according to a third aspect of this invention, the viscoelastic member is disposed at four corners of the lower and upper plates in the large-scale high strength seismic isolator. According to a forth aspect of this invention, the shape of the viscoelastic member is square, rectangular, round, trapezoidal or polygonal. In the large-scale high strength seismic isolator according to a fifth aspect of this invention, the first rolling member is a roller and the second rolling member is a ball or roller.

DETAILED DESCRIPTION OF THE PREFERRED EMBODIMENTS

Hereinafter, an embodiment of the present invention will be explained with reference to the accompanying drawings.

Figure 1:
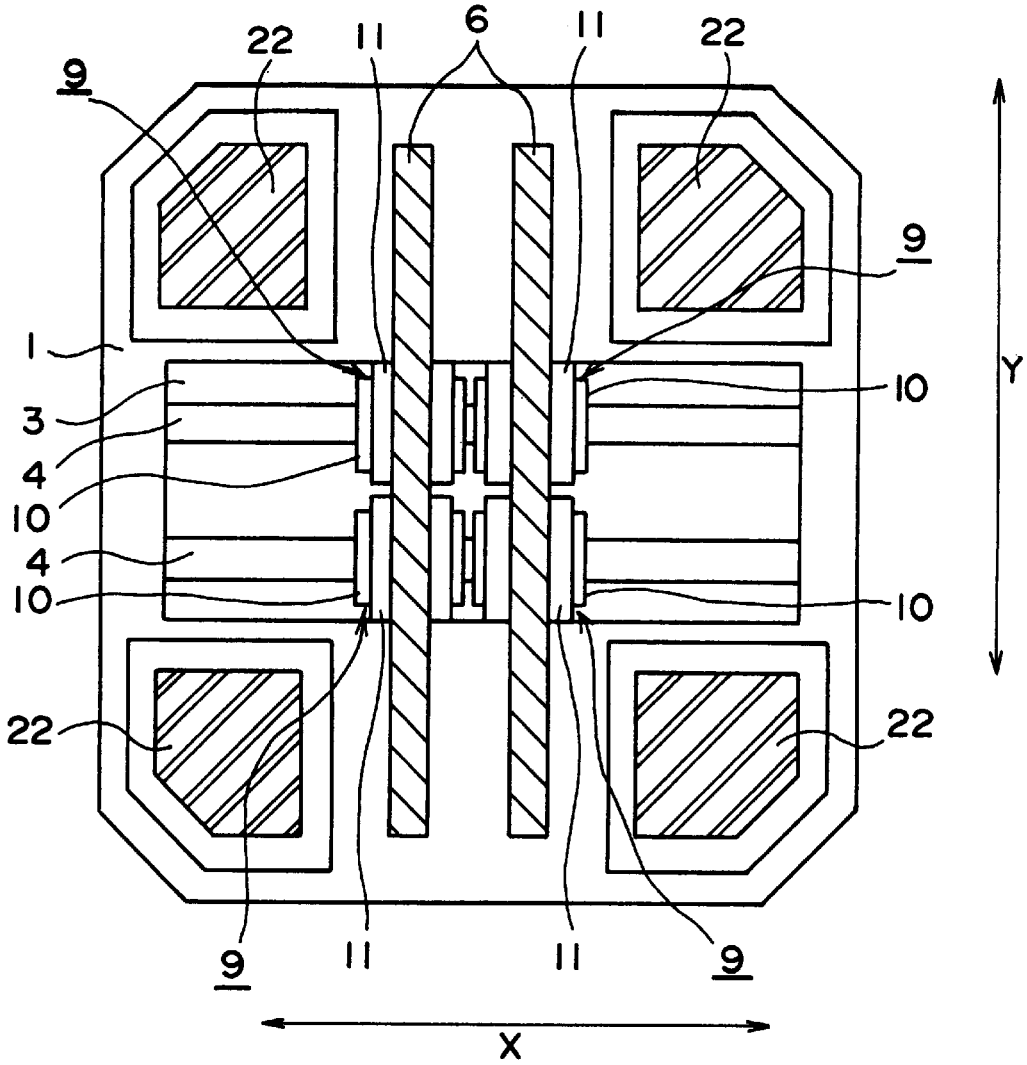
FIG. 1 is a transverse sectional plan view of an embodiment of the present invention when viewed along a line I—I of FIG. 2.
Figure 2:
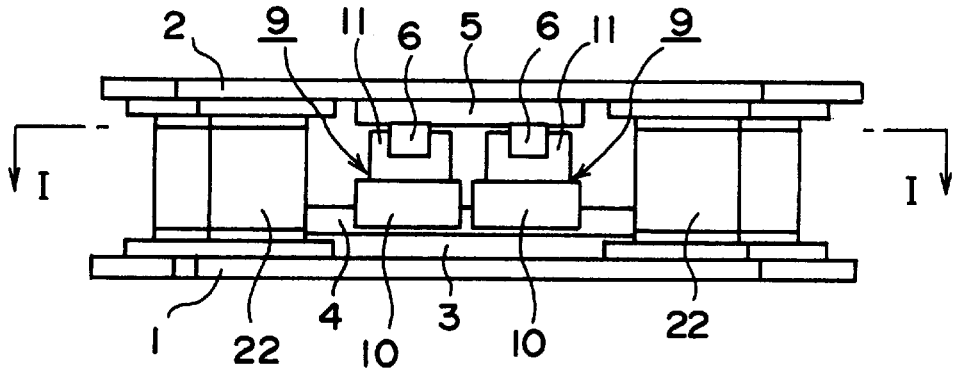
FIG. 2 is a front view of one embodiment of the present invention.

FIG. 1 is a transverse sectional plan view of an embodiment of the present invention when viewed along line I—I of FIG. 2, and FIG. 2 is a front view of FIG. 1. An upper plate 2 is disposed above a lower plate 1, and these lower and upper plates 1 and 2 are flat plates having substantially the same shape. In the embodiment shown in the drawings, the lower and upper plates 1 and 2 are octagonal but they may be shaped into a square or round shape.

Two lower guide rails 4 are fitted to the upper surface of the lower plate 1 in parallel with each other in the transverse direction of the drawings through a lower guide rail fitting plate 3. Though two lower guide rails 4 are shown disposed in the embodiment shown in the drawings, there may be three or more lower guide rails or only one lower guide rail 4 so fitted as to cross transversely the substantial center of the upper surface of the lower plate 1.

Two upper guide rails 6 are fitted to the lower surface of the upper plate 2 through an upper guide rail fitting plate 5 (see FIG. 2) in such a fashion as to orthogonally cross the lower guide rails 4 described above. Though two upper guide rails are shown disposed in the embodiment shown in the drawings, too, they may be three or more parallel upper guide rails 6, or only one upper guide rail 6 so fitted as to transversely cross the substantial center of the lower surface of the upper plate 2.

Figure 4:
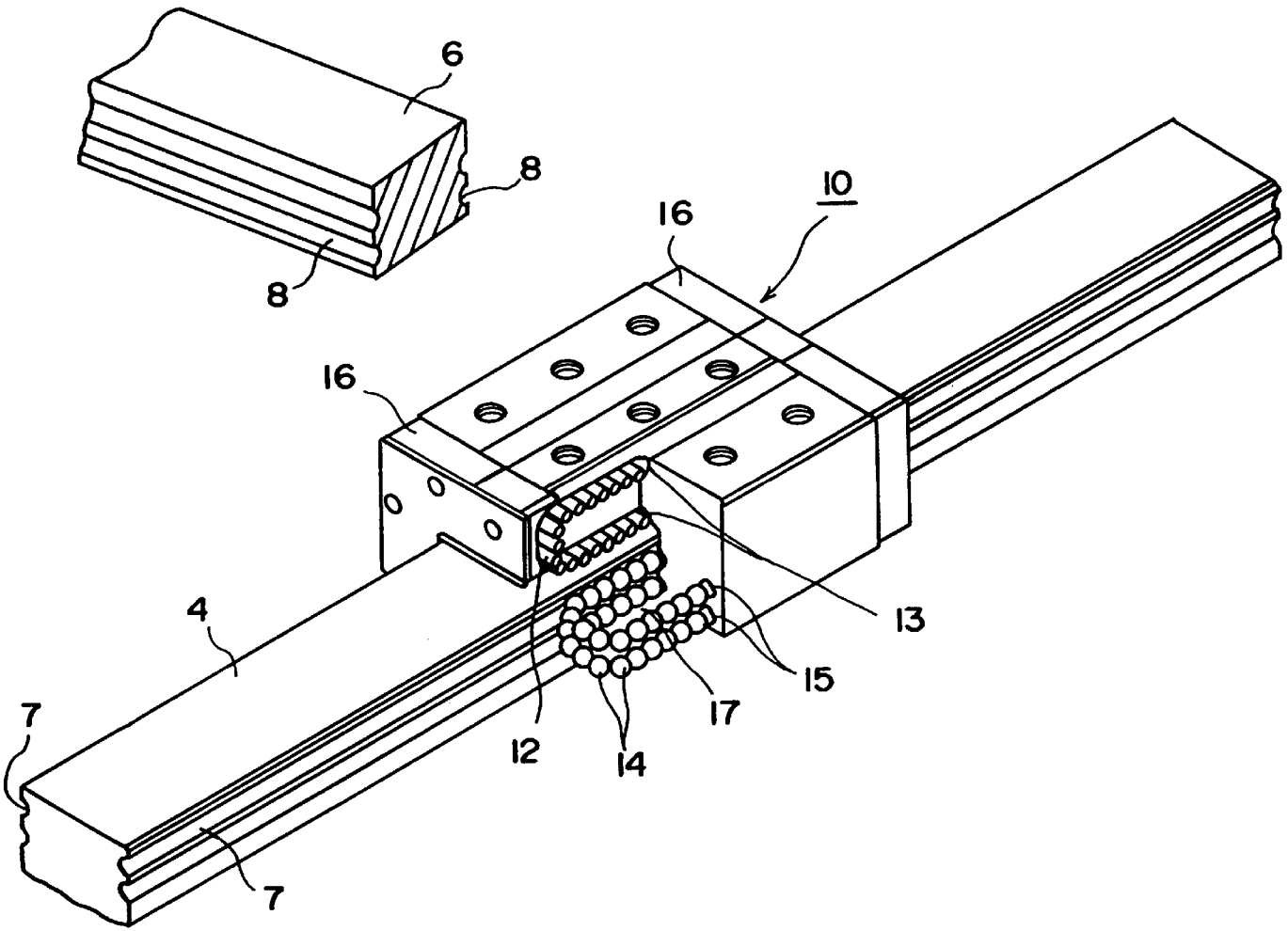
FIG. 4 is a partial cut-away perspective view of the block body.

Continuous grooves 7 are formed in both side surfaces of each lower guide rail 4 as shown in FIG. 4, and continuous grooves 8 are formed similarly on both side surfaces of each upper guide rail 6. Block bodies 9 each clamping movably the lower guide rail 4 and the upper guide rail 6 are disposed between the lower guide rails 4 and the upper guide rails 6, respectively.

Figure 3:
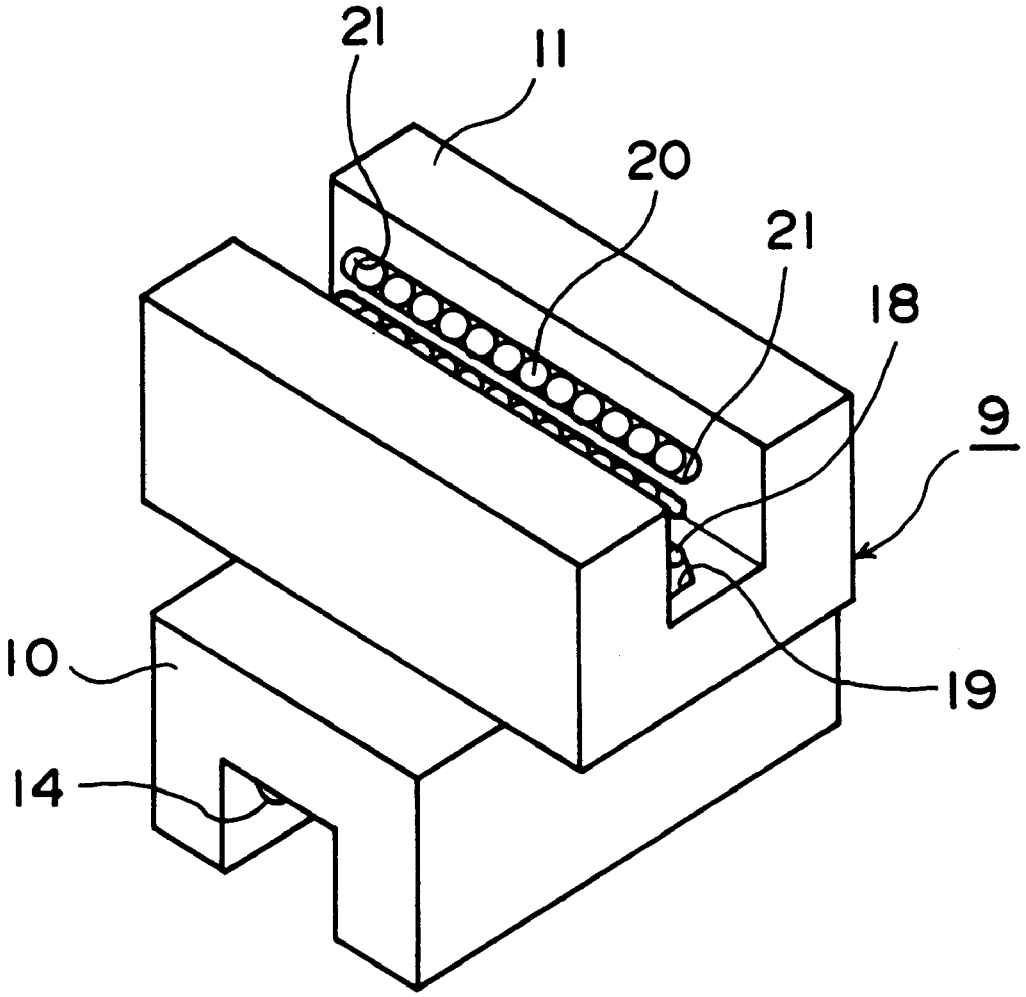
FIG. 3 is a perspective view of an example of a block body.

As shown in FIGS. 1 through 3, the block body 9 comprises a lower block 10 and an upper block 11 integrally combined into a unitary structure. The lower block 10 clamps movably the lower guide rail 4 from above while the upper block 11 clamps movably the upper guide rail 6 from below.

A large number of rollers 12 that are interposed between the upper surface of the lower guide rails 4 and the lower block 10 are provided to the lower block 10 as shown in FIG. 4, and these rollers 12 are allowed to circulate and move through a circulation path 13, formed into a transversely elongated round shape in the perpendicular plane, from the upper surface of the lower guide rail 4 into the lower block 10 while they are rolling.

Further, a large number of balls 14 are interposed between the lower part of the lower block 10, which clamps the lower guide rail 4, and the grooves 7 disposed continuously on both side surfaces of the lower guide rail 4, and these balls 14 are allowed to circulate and move through a circulation path 15, formed into a transversely elongated round shape in the horizontal plane, from the grooves 7 into the lower part of the lower block 10 clamping the lower guide rail 4 while they are rolling so that the lower block 10 does not come off upward from the lower guide rail 4. Rollers may be used in place of the balls 14.

End seals 16 are fitted to both end faces of the lower block 10 and side seals 17 are fitted in such a fashion as to extend from the lower surface of the lower part of the lower block 10 clamping the lower guide rail 4 to the side surface of the lower guide rail 4.

The upper block 11 integrally combined with, and on, the lower block 10 has a structure obtained by turning over the lower block 10 and changing its direction horizontally by 90 degrees, as shown in FIG. 3.

A large number of rollers 18 (see FIG. 3) are interposed between the upper block 11 and the lower surface of the upper guide rail 6 (see FIG. 2) and these rollers 18 are allowed to circulate and move through a circulation path 19 formed into a transversely elongated round shape in the vertical plane inside the upper block 11 while they are rolling.

Further, a large number of balls 20 are interposed between the upper part of the upper block 11 clamping the upper guide rail 6 and the grooves 8 (see FIG. 4) disposed continuously on both side surfaces of the upper guide rail 6, and these balls 20 are allowed to circulate and move through a circulation path 21 formed into a transversely elongated round shape in the horizontal plane, from the grooves 8 into the upper part of the upper block 11 clamping the upper guide rail 6 while they are rolling so that the upper block 11 does not fall off downward from the upper guide rail 6. Rollers may be used in place of the balls 20.

Superplastic rubber dampers 22, or the like, which are a viscoelastomer, are fitted between the lower plate 1 and the upper plate 2 and at both sides of the end portions of the lower guide rail 4 and the upper guide rail 6 as shown in FIGS. 1 and 2.

Next, the operation of the apparatus described above will be explained.

The lower plate 1 is fixed to the foundation and the upper plate 2 (see FIG. 2) is fixed to the lower side of the structure such as a building. Therefore, the load of the structure is borne by the foundation through the upper plate 2, the upper guide rail fitting plate 5, the upper guide rail 6, the rollers 18 (see FIG. 3), the block body 9, the rollers 12 (see FIG. 4), the lower guide rail 4, the lower guide rail fitting plate 3 (see FIGS. 1 and 2) and the lower plate 1.

Figure 5:
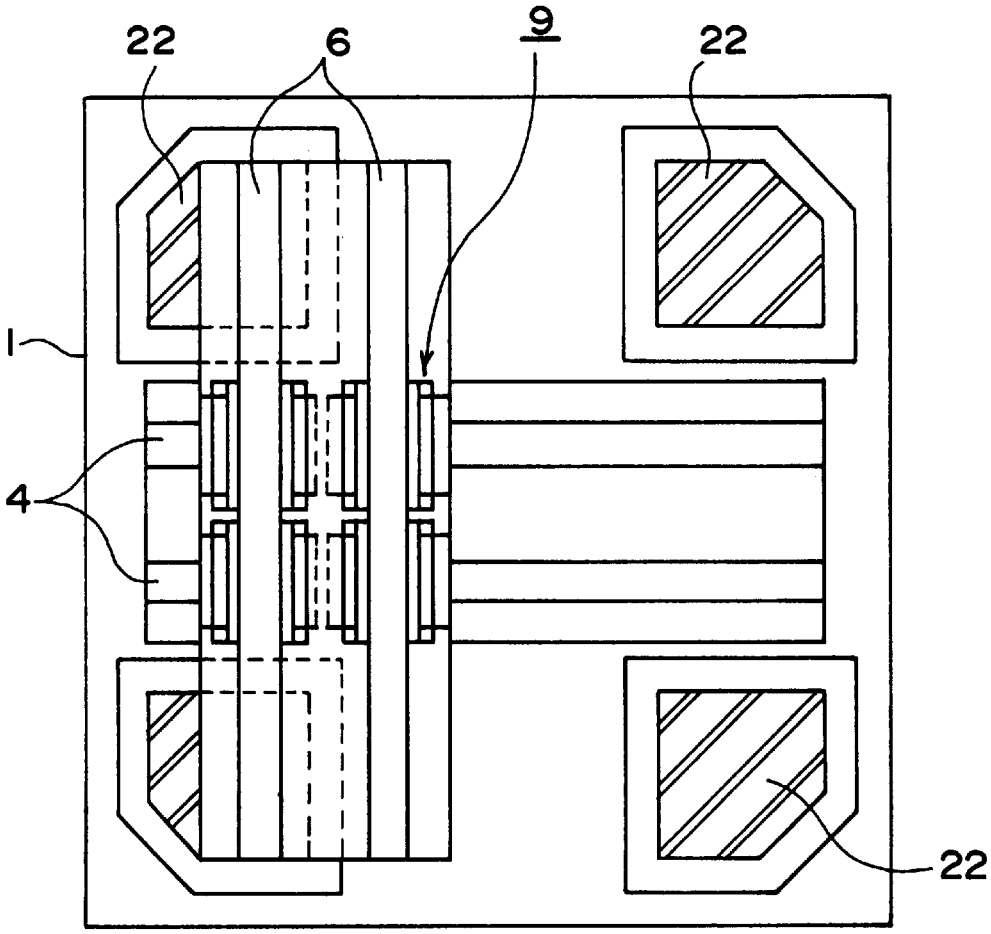
FIG. 5 is a transverse sectional plan view showing the operation state of the embodiment of the present invention.
Figure 6:
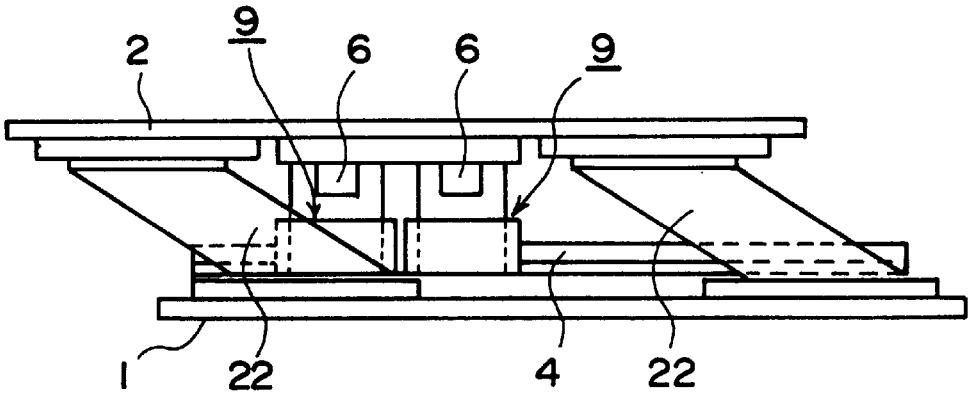
FIG. 6 is a front view of FIG. 5.

When the upper plate 2 undergoes horizontal displacement in the transverse X direction in FIG. 1 with respect to the lower plate 1, the upper plate 2 moves with the upper guide rail 6 and the block body 9 along the lower guide rail 4 as shown in FIGS. 5 and 6. In this instance, the rollers 12 (see FIG. 4) roll while keeping contact with the upper surface of the lower guide rail 4 while the balls 14 roll along the grooves 7 of the lower guide rail 4.

When the upper plate 2 undergoes horizontal displacement in the Y direction in FIG. 1 with respect to the lower plate 1, the upper plate 2 moves with the upper guide rail 6 with respect to block body 9. In this instance, the rollers 18 (see FIG. 3) roll while keeping contact with the lower surface of the upper guide rail 6 whereas the balls 20 roll along the grooves 8 (see FIG. 4) of the upper guide rail 6.

When the upper plate 2 undergoes horizontal displacement with respect to the lower plate 1 as described above, the upper plate 2 can smoothly move even when the weight of the structure applied to the upper plate 2 is extremely great because the rollers 12 and 18 are interposed between the block body 9 and the lower guide rails 4 and between the block body 9 and the upper guide rails 6.

When the length of each of the lower and upper guide rails 4 and 6 is set to a large value, great horizontal displacement capacity can be provided.

When the upper plate 2 undergoes horizontal displacement with respect to the lower plate 1, the upper end portion of the superplastic rubber damper 22 moves with the upper plate 2 and is deformed as shown in FIG. 6. Accordingly, the damper 22 can impart the damping force and the restoring force to the upper plate 2.

When an upward force, that is, a pull-out force, is applied to the upper plate 2, a large number of balls 14 and 20 interposed between the grooves 7 on the side surfaces of the lower guide rails 4 and the block body 9 and between the grooves 8 of the side surfaces of the upper guide rails 6 and the block body 9 inhibit the upward movement of the upper guide rails 6 and the block body 9, so that a large resistance to the pull-out force can be generated.

Now, small-scale model tests are described.

As a simulated model of a very high building, a small-scale six-storied building test model was prepared with a reduction rate of 1/5 with respect to time and a reduction rate of 1/25 with respect to length and the seismic isolator of the present invention was fixed to a foundation of the test model. Vibration tests were conducted, using a shaking table, on the thus prepared test model. The test conditions and main observations on the results obtained from the tests are summarized below.

Figure 7:
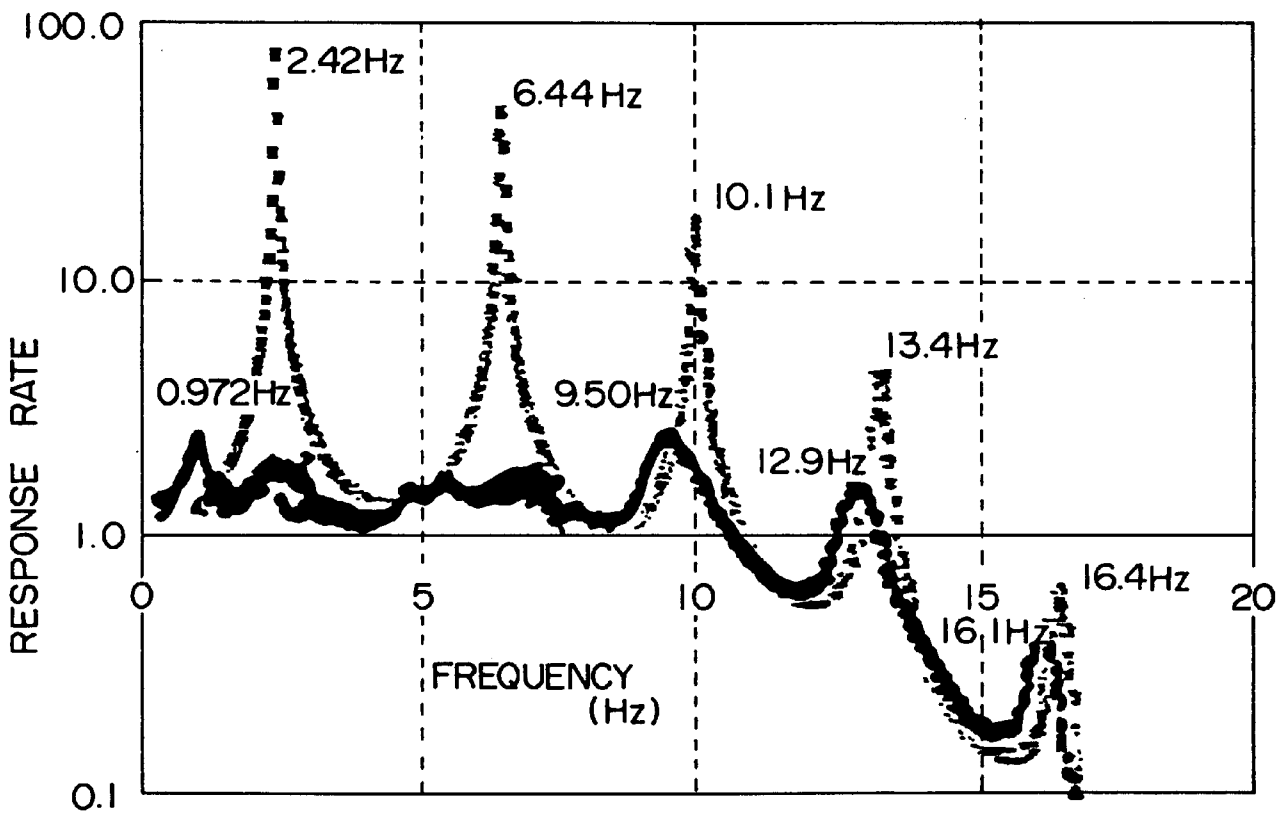
FIG. 7 is a graph showing the results of sinusoidal sweep excitation tests using a shaking table conducted on a small-scale six-storied building test model.

(1) FIG. 7 is a graph showing the results of sinusoidal sweep excitation tests. The test results showed that a fundamental natural frequency of 2.4 Hz without the seismic isolator was changed to a long-period vibration of about 1 Hz due to the isolating effect of the seismic isolator. This corresponds to an isolating effect of from 2 seconds to 5 seconds in period in an actual very high building.

Figure 8:
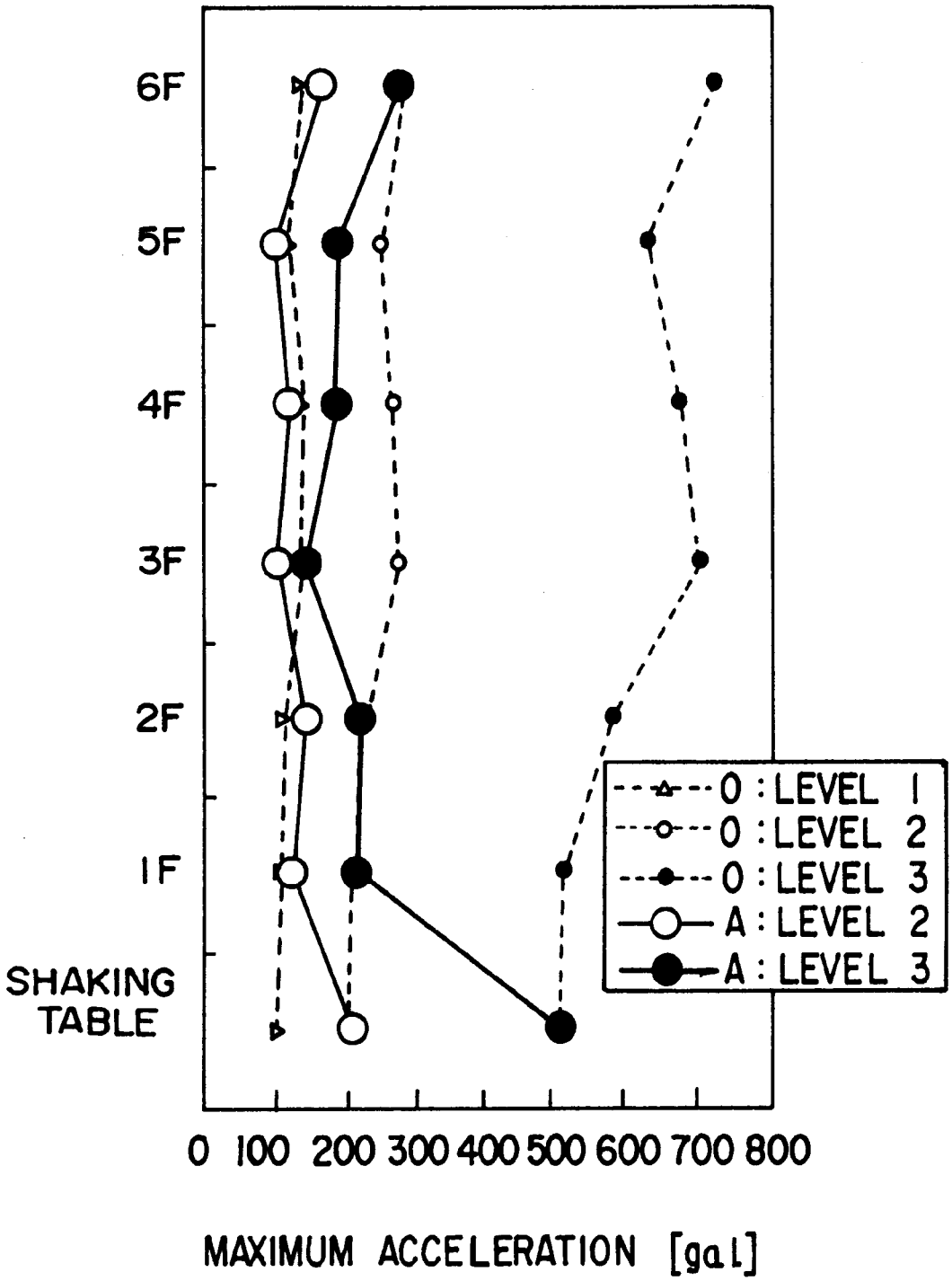
FIG. 8 is a graph showing maximum accelerations when applying horizontal vibrations to the above-mentioned small-scale test model.
Figure 9:
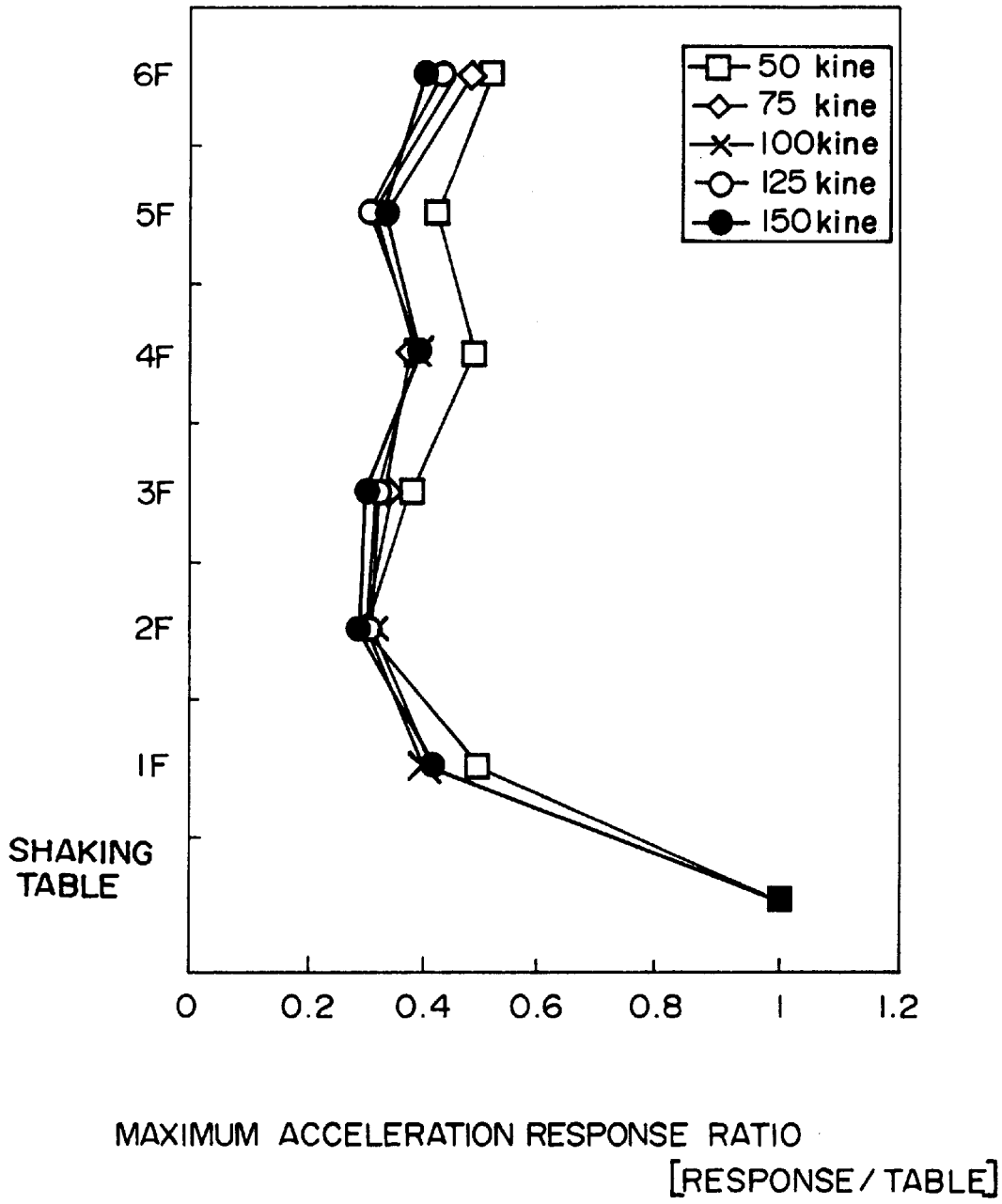
FIG. 9 is a graph showing response ratios for maximum horizontal accelerations at each floor under horizontal vibrations of the order of Hachinohe earthquake.

(2) FIG. 8 is a graph showing maximum accelerations when horizontal vibrations of the order to NS waves of El Centro earthquake were applied to the above-mentioned small-scale test model through the shaking table. Due to the vibration damping effect of the seismic insulator as described in (1), the response maximum acceleration at each floor was reduced to 25 to 40% of the undamped maximum acceleration. "A" and "O" in the box in FIG. 8 represent the maximum accelerations damped by the seismic isolator and the undamped maximum accelerations, respectively, at each shaking level. Further, FIG. 9 is a graph showing the response ratios of the maximum horizontal accelerations at each floor when horizontal vibrations of the order of Hachinohe earthquake were applied. In the upper structure, the maximum acceleration was reduced to 30 to 50% of that applied to the shaking table. Further, in the case of using the seismic insulator of the present invention, any difference was not detected in response depending on the input direction and, therefore, it was confirmed that the seismic insulator smoothly behaved even if vibrations were slantwise inputted.

(3) Even in a case where horizontal and vertical seismic waves were simultaneously inputted, any significant difference in vibration damping effect was not detected in the horizontal direction.

(4) With a view of confirming an enough safety range, excitations of five levels from a maximum excitation of 150 kine (NS waves of Hachinohe earthquake) to a minimum excitation of 50 kine were inputted. The deformation of the superplastic rubber damper at each level was as follows. The maximum deformation was about 300%.

| Maximum Deformation Amount of Superplactic Rubber Damper | | | |
|---|---|---|---|
| 50 kine: | 90.6%, | 75 kine: | 123.9%, |
| 100 kine: | 185.3%, | 125 kine: | 248.9%, |
| 150 kine: | 296.4% | | |

In these tests, it is considered that pull-out force occurred several times. However, it was confirmed that even with a very large amount of deformation, stable behavior could be ensured.

Figure 10:
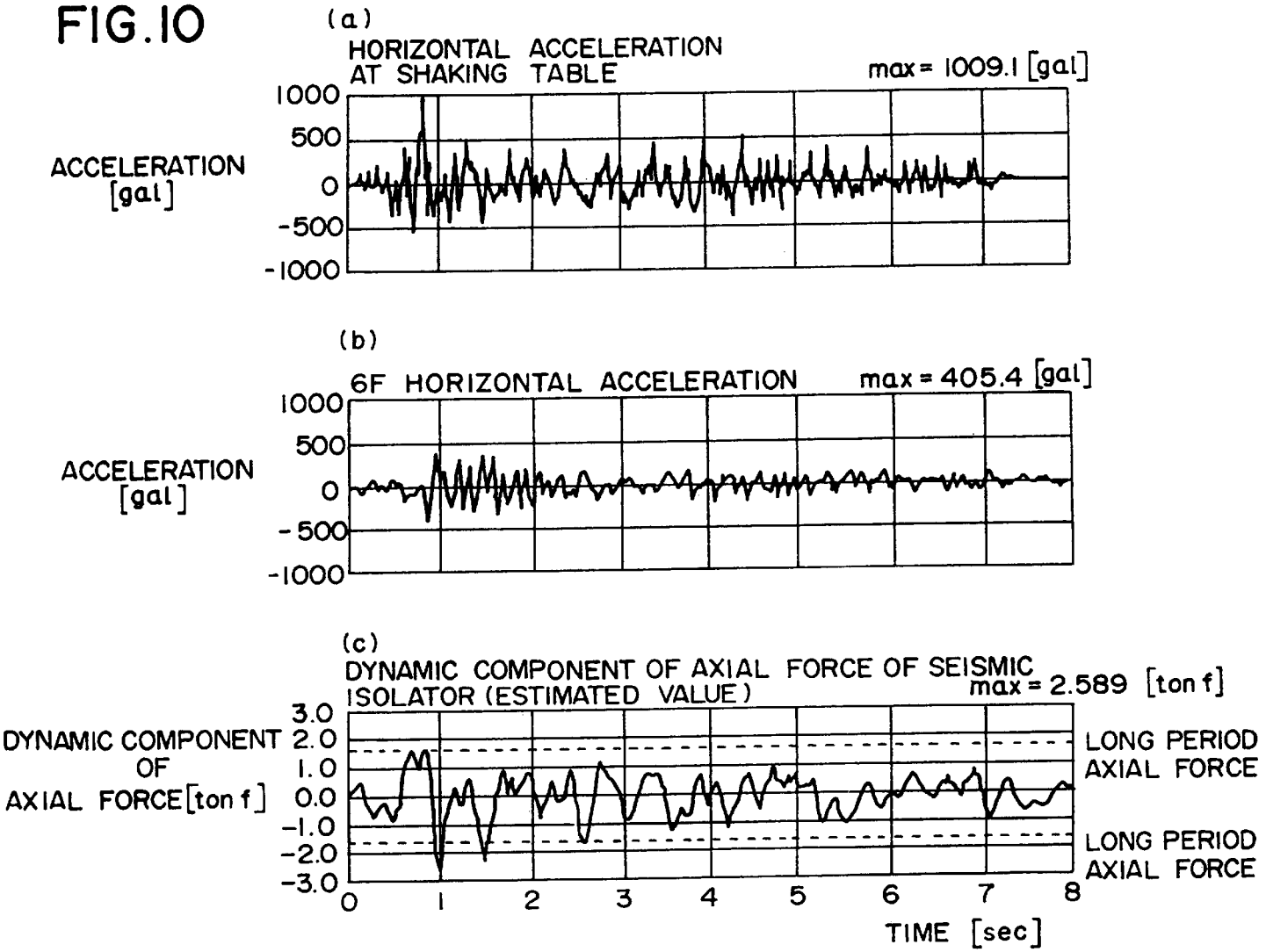
FIG. 10(*a*) to FIG. 10(*c*) are graphs showing accelerations at a shaking table whose maximum horizontal acceleration was 1009.1 gal [FIG. 10(*a*)], horizontal accelerations at the 6th floor of the above six-storied building test model [FIG. 10(*b*)], and the dynamic component of an axial force generated in a seismic isolator of the present invention [FIG. 10(*c*)].

FIG. 10(*a*) to (*c*) are graphs supporting these results. FIG. 10(*a*) shows the acceleration change versus time at the shaking table when a horizontal maximum acceleration of 1009.1 gal was inputted. As shown in FIG. 10(*b*), accelerations at the 6th floor were damped to 405.4 gal or less. FIG. 10(*c*) shows the dynamic component of an axial force generated in the combined block of the seismic insulator. Although the pull-out force values at 1.0 second and 1.5 seconds exceed slightly the estimated safe range (the range between upper and lower dotted lines) of long-period axial force, other pull-out force values are within the safe range. This means that the pull-out force resistance stably exerts.

In the present invention, a large number of rollers are inserted between the upper surface of the lower guide rails and the block body and between the lower surface of the upper guide rails and the block body. Therefore, even when an extremely large weight is applied, the seismic isolator of the present invention can smoothly move in the horizontal direction and exhibits a large load bearing capacity.

A large number of balls or rollers inserted between the grooves of the side surfaces of the lower guide rails and the block body and between the grooves of the side surfaces of the upper guide rails and the block body inhibit the upward movement of the upper guide rails and the block body, so that a large resistance to the pull-out force can be generated.

The load bearing capacity, the pull-out resistance force, the horizontal deformation capacity, the restoring force and the damping force, which are necessary for the seismic isolator, can be set mutually independently, and the load bearing capacity, the pull-out resistance and the horizontal deformation capacity, which are particularly the important factors, can be increased.

Furthermore, because all the constituent members are assembled between the lower plate and the upper plate and unitized, the number of installed members can be appropriately increased or decreased depending on the condition of the building, installation is easy, and the cost of construction can be reduced.

According to the above test results, due to the damping effect of the seismic insulator of the present invention, the response maximum acceleration at each floor was reduced to 25 to 40% of the undamped maximum acceleration. Further, in the upper structure equipped with the inventive seismic insulator, the maximum acceleration was reduced to 30 to 50% of the acceleration inputted into a shaking table. Furthermore, any difference was not detected in response depending on the input direction in the seismic insulator. Accordingly, it was confirmed that the seismic insulator smoothly behaved even if excitation was effected in a slantwise input. Also, in a case where horizontal and vertical seismic waves were simultaneously inputted, any significant difference in vibration damping effect was not detected in the horizontal direction. Input of at most 150 kine (Hachinohe's NS wave) was performed with a view of confirming an enough safety range. As a result, the maximum deformation of a rubber damper disposed in the seismic isolator was about 300%. However, it was confirmed that even when a very large deformation occurred, the seismic insulator showed a safe behavior.

What is claimed is:

1. A large-scale high strength seismic isolator comprising:

a linear lower guide rail having continuous grooves on the side surfaces thereof and fitted to the upper surface of a lower plate;

a linear upper guide rail having continuous grooves on the side surfaces thereof and fitted to the lower surface of an upper plate in a direction orthogonally crossing said lower guide rail;

a block movably body clamping above said lower guide rail at a lower part thereof and clamping below said upper guide rail at an upper part thereof;

a large number of first rolling members inserted between the upper surface of said lower guide rail and said block body and between the lower surface of said upper guide rail and said block body;

a large number of second rolling members inserted between said grooves on the side surfaces of said lower guide rail and said block body and between said grooves of the side surfaces of said upper guide rail and said block body; and a viscoelastic member fitted between the lower surface of said upper plate and the upper surface of said lower plate.

2. A large-scale high strength seismic isolator according to claim 1, wherein said viscoelastic member is disposed in an empty space between said lower and upper guide rails.

3. A large-scale high strength seismic isolator according to claim 2, wherein said viscoelastic member is disposed at four corners of said upper and lower plates.

4. A large-scale high strength seismic isolator according to claim 1, wherein the shape of said viscoelastic member is square, rectangular, round, trapezoidal or polygonal.

5. A large-scale high strength seismic isolator according to claim 1, wherein said first rolling member comprises a roller and said second rolling member comprises a ball.

* * * * *

UNITED STATES PATENT AND TRADEMARK OFFICE

CERTIFICATE OF CORRECTION

PATENT NO. : 5,970,666
DATED : October 26, 1999
INVENTOR(S) : Hiroshi Kurabayashi et al.

It is certified that error appears in the above-identified patent and that said Letters Patent is hereby corrected as shown below:

Column 6;
Line 37, change "block movably body" to --- block body movably ---.
Line 38, after "and" insert --- movably ---.

Signed and Sealed this

Twenty-first Day of August, 2001

*Attest:*

Nicholas P. Godici

*Attesting Officer*

NICHOLAS P. GODICI
*Acting Director of the United States Patent and Trademark Office*